United States Patent [19]

Kamiwaki et al.

[11] 4,182,110

[45] Jan. 8, 1980

[54] ELECTRONIC WRISTWATCH INCLUDING AUXILIARY POWER SUPPLY

[75] Inventors: Osamu Kamiwaki; Wataru Onishi, both of Suwa, Japan

[73] Assignee: Kabushiki Kaisha Suwa Seikosha, Tokyo, Japan

[21] Appl. No.: 864,288

[22] Filed: Dec. 27, 1977

[30] Foreign Application Priority Data

Dec. 27, 1976 [JP] Japan ..... 51-158892

[51] Int. Cl.[2] ..... G04C 3/00

[52] U.S. Cl. ..... 58/23 BA; 58/50 R; 307/64

[58] Field of Search ..... 307/64, 65, 66; 58/23 BA, 23 R, 50 R

[56] References Cited

U.S. PATENT DOCUMENTS

| | | | |
|---|---|---|---|
| 3,757,131 | 9/1973 | Krutz | 307/64 |
| 3,968,864 | 7/1976 | Moyer | 58/23 BA |

*Primary Examiner*—Gene Z. Rubinson
*Assistant Examiner*—Leonard W. Pojunas, Jr.
*Attorney, Agent, or Firm*—Blum, Kaplan, Friedman, Silberman & Beran

[57] ABSTRACT

An electronic wristwatch including an auxiliary power supply for energizing at least the timekeeping circuit when the main power supply is being removed for replacement is provided. The wristwatch includes a high frequency time standard that vibrates at a high frequency and a timekeeping circuit coupled to the high frequency time standard for converting the high frequency vibrations of the time standard into low frequency timekeeping signals representative of actual time. A display is coupled to the timekeeping circuit for displaying actual time in response to the low frequency timekeeping signals applied thereto. The main power supply is coupled to the timekeeping circuit and to the display for delivering a voltage of a sufficient magnitude to operate the timekeeping circuit and display. A voltage detection circuit is selectively coupled to the main voltage supply and is further coupled to the auxiliary voltage supply and detects when the main voltage supply is removed from the wristwatch and, in response thereto, is adapted to couple selectively the auxiliary voltage supply to the timekeeping circuit at least until the main power supply is again returned to the wristwatch.

16 Claims, 6 Drawing Figures

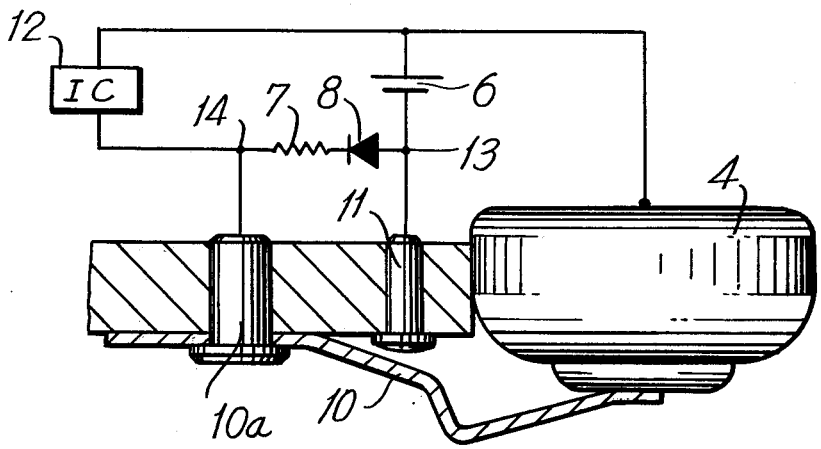
FIG. 2a
FIG. 2b
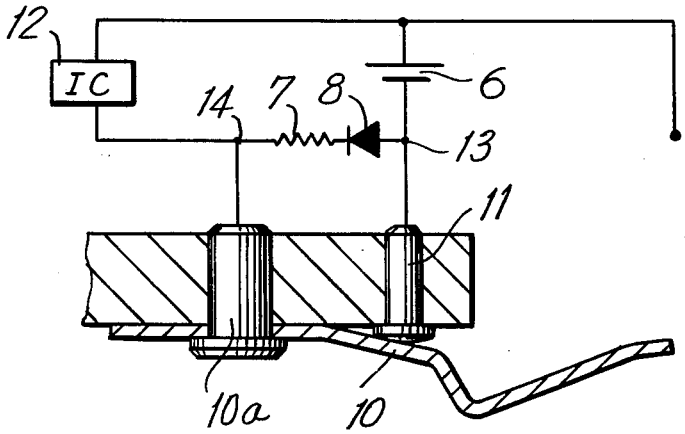

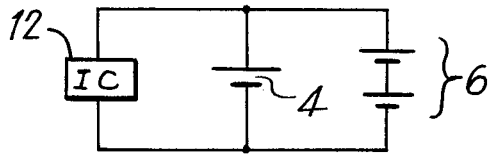
FIG. 3
FIG. 4
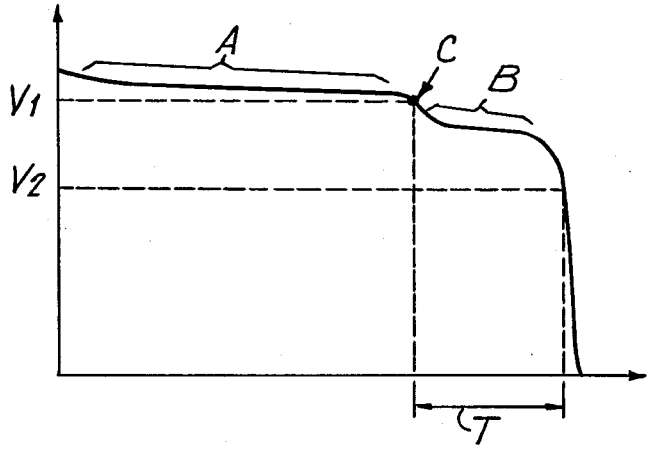

ELECTRONIC WRISTWATCH INCLUDING AUXILIARY POWER SUPPLY

BACKGROUND OF THE INVENTION

This invention is directed to an electronic wristwatch including an auxiliary power supply for energizing the wristwatch when the main power supply is removed for replacement, and in particular to an electronic wristwatch including an auxiliary battery for energizing the timekeeping circuit in an electronic wristwatch in order to insure that the timekeeping information stored therein is not lost when the main battery utilized to energize the wristwatch is removed therefrom in order to replace same.

Electronic wristwatches, and in particular those utilizing a quartz crystal vibrator as a high frequency time standard, have undergone rapid and remarkable technological improvements in the last few years. These improvements have taken into account the timekeeping accuracy of electronic wristwatches, the performance of numerous additional functions such as chronographic operation, calculator operation, etc., and improved assembly techniques leading to more reliable and more highly miniaturized wristwatches. With respect to the accuracy of such electronic wristwatches, it is noted that electronic wristwatches having an accuracy of ten seconds per month have become commonplace, and in fact, timepieces that are accurate to one second a month or three seconds per year have been commercialized. Such highly accurate wristwatches require little if any correction or adjustment unless the DC battery, utilized to energize same, is replaced. Moreover, each time that a battery is replaced, the timekeeping information stored in the timekeeping circuitry volatilizes, thereby rendering it necessary to reset the timekeeping circuit after a new battery is exchanged for a dead battery. Thus, when a new battery is exchanged for an old battery, an external time reference, such as a radio or telephone indication of correct time, must be utilized to correct and adjust the timepiece, a feature which makes electronic wristwatches unacceptable to many consumers.

Similarly, in wristwatches that perform a plurality of functions, in particular digital display wristwatches of the type that operate in a chronographic mode and/or in a calculator mode, a memory is utilized to process the additional functional information. In addition to the hours, minutes and seconds timekeeping information, the type of information and operations such as measuring the month, day, day of the week, year, leap year, elapsed time (stopwatch), world time and alarm signaling are volatilized when the battery is removed from the timepiece. Moreover, all of this information, in a multi-functional timepiece, must once again be restored in the respective counters and registers once the battery is replaced thereby making it necessary for the battery to be replaced by a watchmaker or other person having particular expertise with respect to the information and operations noted above.

Moreover, certain of the different functions performed by a multi-functional timepiece, such as alarm signaling, increase the drain on the battery, thereby requiring the battery to be replaced more often. The more often the battery is replaced, the greater the disadvantages noted above become. Although the size of the battery can be increased, the trend in electronic wristwatch design is toward miniaturization of the timepiece and, in particular, a reduction in the thickness thereof, thereby ruling out increasing the size of the battery in order to reduce the frequency with which same must be replaced. Accordingly, an electronic wristwatch wherein information stored by the timepiece circuitry is not volatilized when the battery is removed from the wristwatch for replacement is desired.

SUMMARY OF THE INVENTION

Generally speaking, in accordance with the instant invention, an electronic wristwatch including an auxiliary battery for energizing at least a portion of the wristwatch circuitry when the main battery is removed for replacement is provided. The electronic wristwatch includes a high frequency time standard adapted to vibrate at a high frequency. A timekeeping circuit is coupled to the high frequency time standard for converting the high frequency vibration of the time standard into a low frequency timekeeping signal representative of actual time. A display is coupled to the timekeeping circuit for displaying time in response to the low frequency timekeeping signal applied thereto. A main power supply is coupled to the timekeeping circuit and to the digital display for delivering thereto a voltage of a sufficient magnitude to operate the timekeeping circuit and digital display. The invention is particularly characterized by the use of an auxiliary voltage supply adapted to selectively deliver to the timekeeping circuit a voltage of a sufficient magnitude to operate the timekeeping circuit and a voltage detection device selectively coupled to the main voltage supply and further coupled to the auxiliary voltage supply in order to detect when the main voltage supply is removed from the timepiece and, in response thereto, selectively couple the auxiliary voltage supply to the timekeeping circuit at least until the main power supply is again returned to the timepiece.

Accordingly, it is an object of the instant invention to provide an improved electronic wristwatch including an auxiliary battery.

A further object of the instant invention is to provide an electronic wristwatch with an auxiliary power supply that prevents the information stored in the timekeeping circuit from being volatilized when the main voltage supply of the wristwatch is removed for replacement.

Still a further object of the instant invention is to provide an analog display electronic wristwatch wherein the analog display is automatically corrected when a new main power supply is disposed in the wristwatch.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which:

FIG. 2*a* is a partial sectional view of an electronic wristwatch including an auxiliary battery constructed in accordance with the embodiment depicted in FIG. 1;

FIG. 2*b* is a partial sectional view of the electronic wristwatch assembly depicted in FIG. 2*a*, with the main battery removed for replacement;

FIG. 3 is a circuit diagram of an electronic wristwatch including an auxiliary battery constructed in accordance with an alternate embodiment of the instant invention;

FIG. 4 is a graphical illustration of the operation of the electronic wristwatch constructed in accordance with an embodiment of the instant invention;

DETAILED DESCRIPTION OF THE PREFERRED EMBODIMENTS

Figure 1:
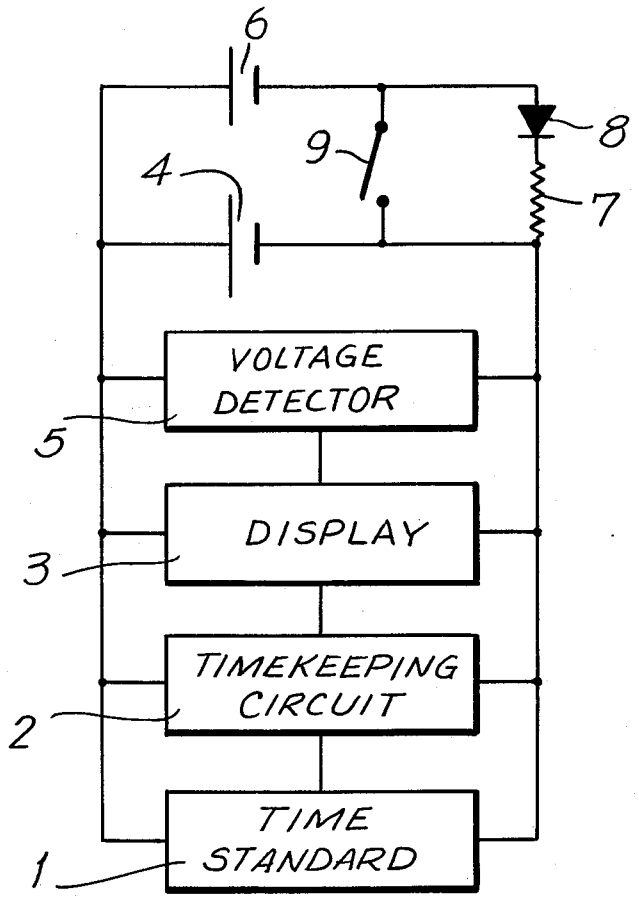
FIG. 1 is a block circuit diagram of an electronic wristwatch including an auxiliary battery constructed in accordance with a preferred embodiment of the instant invention.

Reference is now made to FIG. 1, wherein a block circuit diagram of an electronic wristwatch, including an auxiliary battery is depicted. The electronic wristwatch includes a high frequency time standard 1, such as a quartz crystal vibrator or the like, capable of vibrating at frequencies on the order of $2^{16}$ Hz. The timekeeping circuit 2 of the electronic wristwatch is adapted to convert the high frequency vibration of the time standard into a low frequency timekeeping signal representative of actual time. The timekeeping circuit 2 usually includes an oscillator circuit coupled to the high frequency time standard for converting the vibration of the time standard into a high frequency time standard signal having a frequency substantially equal to the frequency of vibration of the time standard. Additionally, a divider circuit comprised of a plurality of series-connected binary divider stages is adapted to receive the high frequency time standard signal produced by the oscillator circuit and divide same down into the low frequency timekeeping signal. A display 3, either digital or analog, is coupled to the timekeeping circuit for displaying actual time in response to the low frequency timekeeping signal being applied thereto. When the display 3 is an analog display, an electro-mechanical transducer, such as a step motor or the like, is utilized to convert the low frequency timekeeping signal into an incremental rotary motion for driving the clock hands. Alternatively, when the display 3 is a digital display, decoders and drivers are utilized in combination with liquid crystal or light emitting diode display segments, formed in a conventional 7-segment pattern to define each display digit. A main battery 4 is coupled to the display 3, timekeeping circuit 2 and time standard 1 in order to deliver thereto a voltage of a sufficient magnitude to operate same over long periods of time. Accordingly, during normal operation, the main battery 4 operates the electronic wristwatch as long as the voltage delivered thereby is of a sufficient magnitude.

A voltage detector 5 is coupled intermediate the main battery 4 and the display 3, timekeeping circuit 2 and time standard 1 in order to detect when the magnitude of the voltage delivered by the main battery 4 begins to drop thereby signaling the impending failure of the main battery 4. An auxiliary battery 6 is coupled in series with a diode 8 and resistor 7, and in parallel with main battery 4. A switch 9, which is normally disposed in an open condition, is coupled intermediate the main battery 4 and auxiliary battery 6, and remains open until the main battery 4 is removed from the wristwatch for replacement.

Accordingly, the magnitude of the voltage delivered by auxiliary battery 6 should be selected to be below the drop in voltage of the main battery 4 detected by the voltage detector 5, and above the voltage level required to insure that the wristwatch continues to operate. When the auxiliary battery is so selected, the voltage delivered by the main battery 4 is continually applied to the auxiliary battery 6 and thereby maintains same fully charged to and including the time that the voltage detector 5 detects a drop in the voltage of the main battery 4. Once the voltage detector detects a drop in the magnitude of the voltage delivered by the main battery, a battery monitoring indication device will indicate to the wearer of the wristwatch the impending failure of the main battery and the necessity for replacing same.

When the main battery is removed for replacement, the auxiliary battery 6 will then be coupled to the wristwatch and will deliver the same, for several minutes, a voltage of a magnitude sufficient to continue operating the wristwatch. Once a new battery is replaced in the wristwatch, the auxiliary battery will again be charged to a 100% capacity by the main battery, and hence be ready for use the next time that the main battery is again removed for replacement.

It is noted that the resistor 7 is provided for limiting the current flow through the auxiliary battery 6, which current flow is usually unnecessary, once same has been fully charged. Moreover, as noted below, the resistor 7 and diode 8 can be eliminated in certain circumstances.

Accordingly, the instant invention is particularly characterized by the use of a voltage detector for detecting the impending failure of a main battery in order to prevent the electronic wristwatch from ceasing to operate when the battery is fully dissipated. Specifically, if the drop in the voltage delivered by the main battery is detected and if an auxiliary battery is utilized to energize the wristwatch circuitry when the failing main battery is replaced with a new battery, none of the timekeeping information and timekeeping control information stored in the timekeeping circuit need be volatilized. This is not only the case with memory circuits that are often formed of non-volatile storage elements, but additionally the C-MOS divider stages, counters and control circuits normally utilized to synthesize the timekeeping circuit in an electronic wristwatch. By preventing the timekeeping information from being volatilized when the main battery is replaced, the wearer can replace the main battery without the aid of an authorized service or repair person. Moreover, since it takes only several minutes to replace the main battery, the auxiliary battery can be much smaller than the main battery inasmuch as it is only necessary for the auxiliary battery to energize the timekeeping circuit of the electronic wristwatch for the few minutes that are required to replace the main battery.

A preferred type of auxiliary battery is one the size of a chip-type capacitor now utilized in electronic wristwatches. Such auxiliary batteries can be permanently secured in an electronic wristwatch when the integrated circuit is formed. It is noted, however, that one disadvantage of substantially reducing the size of the auxiliary battery is that it then becomes difficult for same to deliver a large current to drive a load. For example, a very small auxiliary battery would not be capable of driving a buzzer alarm, illuminating an indication lamp or driving a step motor. Thus, if any of these functions were required to be performed by a very small auxiliary battery during the interval that the main battery is removed for replacement, the auxiliary battery will be quickly dissipated and will then be unable to deliver a sufficient voltage to energize the timekeeping circuit. The specific problem sought to be avoided by providing an auxiliary battery, namely, preventing the time standard from stopping and the timekeeping circuit from stopping, and hence preventing the information stored therein from volatilizing, would occur if the auxiliary battery were fully dissipated during the several minutes required to remove the main battery from the wristwatch for replacement. It is therefore necessary to prohibit the timekeeping functions performed by the wristwatch, that consume a large current, from being performed when the main battery is removed for replacement. Specifically, it is necessary to prevent the specific functions from occurring, such as the buzzer alarm being actuated, when the main battery is being replaced in order to assure that the timekeeping circuit of the wristwatch does not stop operating so that the information stored therein is not volatilized.

Reference is now made to FIG. 2*a* wherein a switching mechanism for detecting the removal of the main battery 4 from an electronic wristwatch is depicted, like reference numerals being utilized to denote like elements described above. It is noted that the main battery 4 is coupled in parallel with the auxiliary battery 6. A resilient lead plate 10 is disposed in contact with the negative pole of the main battery 4 and is positioned by a conductive pin 10*a*. Additionally, the conductive pin 10*a* couples the resilient lead plate 10 through node 14 to an integrated circuit 12 having the timekeeping circuit of the electronic wristwatch integrated therein. It is noted that the resilient lead plate 10 is disposed out of contact with the conductive pin 11 when the main battery 4 is in its normal position in the wristwatch. As is illustrated in FIG. 2*b*, when the main battery 4 is removed from the wristwatch for replacement, the resilient lead plate 10 contacts the conductive pin 11, and thereby couples the auxiliary battery 6 through node 13, conductive pin 11, lead plate 10, conductive pin 10*a* and node 14 to the timekeeping circuit integrated into the IC 12. Thus, when the main battery 4 is removed from the timepiece, the auxiliary battery 6 is coupled to the integrated circuit 12 in order to drive same in the manner discussed above. Moreover, detection circuitry can be utilized to detect the difference in voltage between the nodes 13 and 14 in order to inhibit any of the functions that would consume a considerable amount of current from being performed when the integrated circuit 12 is energized by the auxiliary battery.

It is noted that the instant invention is not limited to the use of a resilient lead plate for mechanically detecting when the main battery is removed from a wristwatch. Instead, other mechanical and electrical sensing mechanisms can be utilized to couple the auxiliary battery to the integrated circuit 12 when the main battery is removed from the wristwatch for replacement. Moreover, since it will be necessary to replace the main battery at least once every few years, the watch case must be provided with means for permitting access to the main battery. It is noted, however, that with respect to the auxiliary battery, as noted above, it is not necessary to ever exchange same, and therefore some can be formed with the integrated circuitry when the electronic timepiece is manufactured without the necessity of providing access to the wearer and, hence, the case need not be provided with an opening therefor.

The auxiliary battery can be formed of a solid electrolytic cell or a neutral salt electrolytic cell. Both types of batteries are characterized by the facility with which same can be sealed and preserved for long periods of time, when compared with batteries utilizing KOH and/or NaOH as an electroltye. Examples of solid electrolytic auxiliary batteries, for use in the instant invention, are as follows:

| SOLID ELECTROLYTIC BATTERIES | | | |
|---|---|---|---|
| NEGATIVE POLE | ELECTROLYTE | POSITIVE POLE | VOLTAGE |
| Ag | $RbAg_4I_5$ | AgI | 0.6 0.7 V |
| Zn | " | " | 0.6 0.7 V |
| C | " | " | 0.6 0.7 V |
| Ag | $Ag_3SI$ | $V_2O_5$ | 0.46 V |
| " | " | $CuBr_2$ | 0.73 V |
| " | AgI | Pt | 0.4 V |
| " | " | Pd | 0.47 V |
| " | " | Au | 0.64 V |
| " | " | $V_2O_5$ | 0.46 V |

Examples of neutral sales electrolytic batteries, suitable for use with the instant invention, are:

| NEUTRAL SALTS ELECTROLYTIC BATTERIES | | | |
|---|---|---|---|
| NEGATIVE POLE | ELECTROLYTE | POSITIVE POLE | VOLTAGE |
| Zn | $ZnCl_2$ water solution | AgCl | 0.9 V |
| Zn | Glycol ammonium borate | $V_2O_5$ | 1.2 V |

It is noted that each of the solid electrolytic and neutral salt electrolytic auxiliary batteries listed above deliver a voltage having a low magnitude. Accordingly, it is often necessary to utilize two or three cells connected in series in order to deliver a voltage having a sufficient magnitude. As aforenoted, the voltage delivered by the auxiliary battery should have a magnitude that is less than the magnitude of the voltage delivered by the main battery and greater than the magnitude of the voltage required to prevent the electronic wristwatch from stopping. Accordingly, the type of auxiliary battery and the number of cells connected in series must be selected with this design requirement in mind. Moreover, as detailed above, if the magnitude of the voltage delivered by the auxiliary battery is less than the voltage drop required to actuate the voltage detector, the capacity of the auxiliary battery is not consumed until the drop in the main battery is detected, thereby optimizing the presence of an auxiliary battery in the electronic wristwatch.

In the embodiment described above, the main battery is coupled in parallel with the auxiliary battery through a series-coupled resistor 7 and diode 8. However, if the current consumption resulting from the current flow through the auxiliary battery delivered by the main battery can be reduced, by selecting the voltage of the auxiliary battery, the resistor and diode can be eliminated. As is illustrated in FIG. 3, like reference numerals being utilized to denote like elements described above, the main battery 4 can be coupled in parallel with the auxiliary battery or batteries 6. As is illustrated in FIG. 4, the discharge characteristic of the main battery 4, when same is coupled directly in parallel with auxiliary battery 6, is a two-stage characteristic. Specifically, the first stage A indicates the operation of the electronic wristwatch when the main battery 4 is delivering a voltage of a sufficient magnitude to operate the electronic wristwatch in the usual manner. The second stage, indicated by the curve B, is the interval in which the auxiliary battery will optimally energize the timekeeping circuit of the electronic wristwatch. Specifically, at voltage level $V_1$, a drop in the magnitude of voltage delivered by the main battery 4 is detected. The voltage level $V_2$ represents the voltage level at which the electronic wristwatch will stop operating. Accordingly, at the point C, when the wearer of the wristwatch is warned that the voltage delivered by the main battery 4 has dropped, there is a period T thereafter before the main battery will fall below the threshold level $V_2$. During the period T (portion B of the curve) the main battery should be replaced. It is noted that batteries utilized in wristwatches have a two-stage characteristic of the type depicted in FIG. 4. In prior art timepieces, this two-stage characteristic has been utilized to provide a warning period during which the electronic wristwatch can be taken to a service station in order to permit the battery to be replaced with a new battery. It is noted, however, that the interval T varies considerably for each battery so that some wristwatches will stop within a day from the point C whereas others may operate for several weeks thereafter. However, if an auxiliary battery is connected in parallel with the main battery in the manner depicted in FIG. 3, the length of the interval T, during which the second stage of operation B of the wristwatch, can be lengthened to insure at least a two week period from the time C that the voltage level of the main battery drops to the detection level $V_1$. By this arrangement the wearer of the timepiece is assured that the wristwatch will continue to operate for a predetermined time after the detection circuit detects a drop in the main battery.

It is further noted that the two-stage characteristic can be utilized to advantage by utilizing a silver peroxide battery. Silver peroxide batteries have an energy density per unit volume that is 1.5 times greater than silver oxide batteries. Moreover, silver oxide batteries are not capable of admitting of a two-stage characteristic of the type depicted in FIG. 4, and hence cannot be utilized to provide a warning of the impending failure of the battery. Accordingly, by utilizing an auxiliary battery in combination with a main silver peroxide battery, an improved electronic wristwatch can be provided.

Accordingly, when the electronic wristwatch includes a liquid crystal digital display, the time displayed thereby can be sustained by the auxiliary battery when the main battery is removed for replacement. Moreover, the timekeeping information stored in the timekeeping circuitry and, additionally, any memories utilized therewith, are prevented from being volatilized by the auxiliary battery. However, when an analog display quartz crystal wristwatch, utilizing a step motor as an electromechanical transducer is utilized, a small-sized auxiliary battery cannot produce sufficient current peaks to drive the step motor. Specifically, a current peak on the order of several hundred $\mu$A is required in order to incrementally step the rotor of a step motor. If the step motor is driven by the auxiliary battery when the main battery is removed for replacement, in addition to the likelihood that sufficient current peaks will not be generated to effect each stepping of the motor, the auxiliary battery can be so rapidly dissipated that the timekeeping circuit, or portions thereof, such as the oscillator circuit, divider circuit or memory circuits, may either be rendered inoperative or the information stored therein volatilized as a result thereof. Moreover, the step motor should therefore not be driven when the main battery is removed for replacement. Although this prevents the problems noted above, the clock hands will not advance during the period that the main battery is removed. In order to overcome this disadvantage, the number of pulses produced during the period that the main battery is removed for replacement can be counted, and thereafter, when a new battery is inserted in the timepiece, the clock hands can be advanced by the number of pulses counted during the replacement interval. By such an arrangement, the display of time remains correct when the main battery is removed for replacement, and numerous adjustments including the correction of the time display is avoided.

Figure 5:
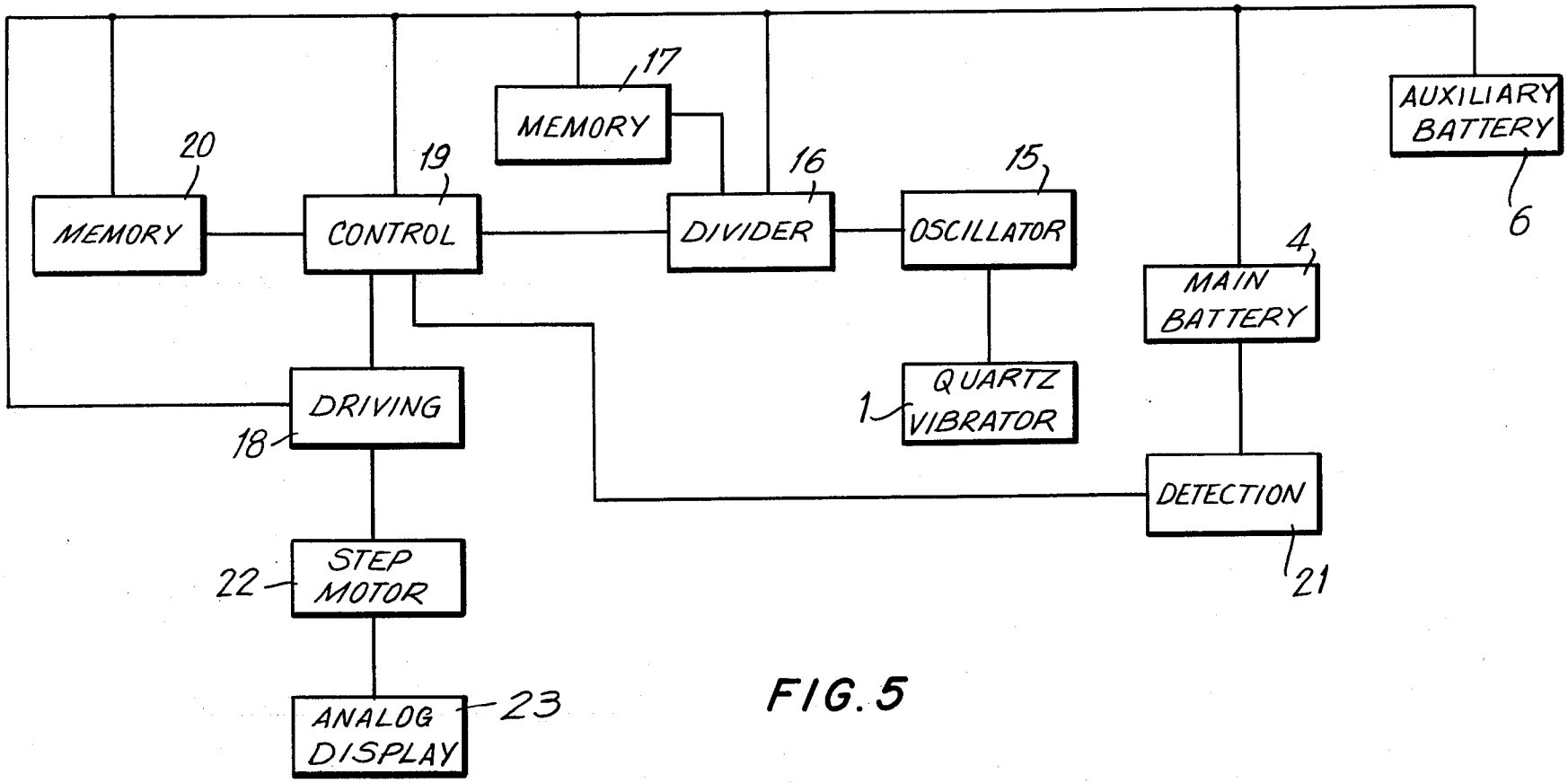
FIG. 5 is a block circuit diagram of an analog display electronic wristwatch constructed in accordance with still a further embodiment of the instant invention.

Reference is now made to FIG. 5, wherein analog display wristwatches capable of counting the pulses produced when the main battery is removed for replacement is provided, like reference numerals being utilized to denote like elements discussed above. A quartz crystal vibrator time standard 1 is coupled to an oscilator circuit 15 in order to produce a high frequency time standard signal and produces a low frequency timekeeping signal. A memory 17 is coupled to the divider circuit 16 and stores therein a division ratio adjustment signal for adjusting the division ratio of the divider in a conventional manner. A drive circuit 18 is coupled to a control circuit 19 and in a normal operating mode, receives the low frequency timekeeping signal produced by the divider 16 and applies same to the step motor 22 to effect a driving of same. The step motor 22 is coupled to an analog display including a gear train and a plurality of clock hands that are incrementally rotated by each stepping of the step motor 22. Detection circuit 21 is coupled to the main battery 4 and detects when same is removed from the wristwatch for replacement. When removal of the main battery is detected by detection circuit 21, the control circuit 19 is actuated thereby. The actuated control circuit 19 is adapted to inhibit the application of the low frequency timekeeping signals produced by the divider 16 to the driving circuit 18, to thereby prevent the step motor from being operated. Instead, the control circuit 19 counts each of the pulses produced by the divider circuit 16 and stores same in memory 20. However, when the detection circuit detects that a new main battery has been replaced in the wristwatch, the control circuit no longer prevents the low frequency timekeeping signal from being applied to the driving circuit 18 and, in addition, permits the memory 20 to feed the number of pulses, stored in the memory 20, to the driving circuit 18 to quickly advance the clock hands of the analog display and thereby correct the positioning of the clock hands and provide a correct display of time.

As detailed above, the instant invention is particularly characterized by preventing any additional adjustments when the main battery is removed for replacement. Specifically, by providing an auxiliary battery, having a capacity that is less than the capacity of the main battery, the auxiliary battery can be utilized to energize those portions of the timekeeping circuit that have information stored therein. Moreover, the person wearing the wristwatch can replace the main battery since adjustment by the watchmaker need no longer be made after the main battery is replaced.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. In an electronic wristwatch including a high frequency time standard capable of vibrating at a high frequency, timekeeping circuit means coupled to said high frequency time standard for converting the high frequency of vibration of said time standard to low frequency timekeeping signals representative of actual time, display means coupled to said timekeeping circuit means for displaying time in response to said low frequency timekeeping signals applied thereto, and a main power supply coupled to said timekeeping circuit means and said display means for delivering a voltage of a sufficient level to operate said timekeeping circuit means and display means, the improvement comprising an auxiliary voltage supply adapted to selectively deliver to said timekeeping circuit means a voltage of a sufficient level to operate said timekeeping circuit means and voltage detecting means selectively coupled to said main voltage supply means, said voltage detecting means being coupled to said auxiliary voltage supply means for detecting when said main voltage supply is removed from said timepiece, and in response thereto being adapted to selectively couple said auxiliary voltage supply to said timekeeping circuit means to thereby operate said timekeeping circuit means at least until said main power supply is again returned to said timepiece.

2. In an electronic wristwatch including a high frequency time standard capable of vibrating at a high frequency, timekeeping circuit means coupled to said high frequency time standard for converting the high frequency of vibration of said time standard to low frequency timekeeping signals representative of actual time, display means coupled to said timekeeping circuit means for displaying time in response to said low frequency timekeeping signals applied thereto, and a main power supply coupled to said timekeeping circuit means and said display means for delivering a voltage of a first level to operate said timekeeping circuit means and display means during normal timekeeping operation of said wristwatch, the improvement comprising an auxiliary voltage supply adapted to selectively deliver to said timekeeping circuit means a voltage of a second level below said first level but sufficient to operate said timekeeping circuit means and voltage detecting means selectively coupled to said main voltage supply, said voltage detecting means being coupled to said auxiliary voltage supply means for detecting when the first voltage level delivered by said main voltage supply drops to a third level that is less than said first voltage level and is greater than said second voltage level and in response thereto is adapted to selectively couple said auxiliary voltage supply to said timekeeping circuit means to operate same at least until a main power supply capable of delivering a first voltage level that is above said third voltage level is connected to said timekeeping circuit means and display means.

3. An electronic wristwatch as claimed in claim 2, wherein said auxiliary voltage supply is further adapted to deliver a voltage of a second level to said timekeeping circuit when said main voltage supply is removed from said wristwatch.

4. An electronic wristwatch as claimed in claim 3, wherein said wristwatch includes function means coupled to said main voltage supply and said timekeeping circuit means for performing a predetermined timekeeping function when said timekeeping circuit means is energized by said main voltage supply, said function means admitting of a large current consumption when a function is performed thereby and being prevented from operating when said main voltage supply is removed from said wristwatch for replacement.

5. An electronic wristwatch as claimed in claim 2, wherein said wristwatch includes function means coupled to said main voltage supply for performing a predetermined timekeeping function when a voltage of a first level is delivered thereto, said function means being coupled to said voltage detection means for preventing said function from being performed thereby when said voltage detection means detects a drop in the voltage delivered by said main voltage supply to said third level.

6. An electronic wristwatch as claimed in claim 1, wherein said voltage detection means includes a mechanical detector for detecting the absence of said main voltage supply when same is removed from said wristwatch and in response thereto for coupling said auxiliary voltage to said timekeeping circuit means.

7. An electronic wristwatch as claimed in claim 1, wherein said main voltage supply is a main battery capable of delivering a predetermined voltage during normal operation and said auxiliary voltage supply is an auxiliary battery having a smaller capacity than said main battery for delivering a voltage during normal operation that is less than said predetermined voltage, said auxiliary battery being sealed and capable of being preserved for a long period of time.

8. An electronic wristwatch as claimed in claim 7, wherein said main battery is a silver peroxide battery.

9. An electronic wristwatch as claimed in claim 8, wherein said auxiliary battery is a neutral salt electrolytic battery.

10. An electronic wristwatch as claimed in claim 7, wherein said auxiliary battery is a neutral salt electrolytic cell.

11. An electronic wristwatch as claimed in claim 10, wherein said auxiliary battery is comprised of a plurality of series-coupled solid neutral salt electrolytic cells.

12. An electronic wristwatch as claimed in claim 7, wherein said auxiliary battery is a solid electrolytic cell.

13. An electronic wristwatch as claimed in claim 8, wherein said auxiliary battery is a solid electrolytic cell.

14. An electronic wristwatch as claimed in claim 7, wherein said auxiliary battery is coupled in series with a resistor and a diode, and said auxiliary battery, resistor and diode are coupled in parallel with said main battery.

15. An electronic wristwatch as claimed in claim 1, wherein said display means is an analog display, control means disposed intermediate said timekeeping circuit means and said analog display means, and memory means coupled to said control means, said control means being coupled said voltage detection means for detecting when said main voltage supply is removed from said wristwatch, and in response thereto being adapted to inhibit the application of said low frequency timekeeping signal to said analog display means and to apply said low frequency timekeeping signal to said memory means to store a count representative of said low frequency timekeeping signal therein, said control means being further adapted in response to a main power supply being returned to said wristwatch to apply the count of said low frequency timekeeping signal stored in said memory to said analog display and thereby correct the time indicated thereby.

16. An electronic wristwatch as claimed in claim 15, wherein said analog display includes a step motor, said control circuit means being adapted to prevent said step motor from operating when said main voltage supply is removed from said wristwatch.

* * * * *